United States Patent [19]

Farish

[11] 4,110,580

[45] Aug. 29, 1978

[54] GAS-TYPE CIRCUIT-INTERRUPTERS HAVING ADMIXTURES OF HELIUM WITH SMALL CONCENTRATIONS OF SULFUR-HEXAFLUORIDE ($SF_6$) GAS

[75] Inventor: Owen Farish, Glasgow, Scotland

[73] Assignee: Westinghouse Electric Corp., Pittsburgh, Pa.

[21] Appl. No.: 719,203

[22] Filed: Aug. 30, 1976

[51] Int. Cl.[2] ..... H01H 33/22

[52] U.S. Cl. ..... 200/148 G; 200/148 B; 200/150 A

[58] Field of Search ..... 200/150 A, 148 G, 148 B, 200/148 R; 174/17 GF

[56] References Cited

U.S. PATENT DOCUMENTS

| | | | |
|---|---|---|---|
| 2,038,507 | 4/1936 | Edsall | 200/150 A |
| 2,853,540 | 9/1958 | Camilli et al. | 200/148 G |
| 2,989,577 | 6/1961 | Berg | 200/148 G |
| 3,674,696 | 7/1972 | Griffiths | 174/17 GF |

FOREIGN PATENT DOCUMENTS

| | | | |
|---|---|---|---|
| 1,041,570 | 10/1958 | Fed. Rep. of Germany | 200/148 G |

*Primary Examiner*—Robert S. Macon
*Attorney, Agent, or Firm*—W. R. Crout

[57] ABSTRACT

An improved gas-type circuit-interrupter is provided utilizing a mixture of helium and sulfur-hexafluoride ($SF_6$) gases, with the percentage concentration of sulfur-hexafluoride ($SF_6$) gas being 10%, or less, by volume.

The improved gas-type circuit-interrupter of the present invention may be utilized to advantage as a "puffer-type" circuit-interrupter, in which relative movement between a piston and operating cylinder takes place for forcing the compressed gas to flow through a suitably-located orifice, or nozzle member, and into intimate engagement with the established arc disposed therein to effect its extinction.

Another form of the gas-type circuit-interrupter of the present invention may include a pressurized gas-reservoir chamber containing the aforesaid admixture of the helium and sulfur-hexafluoride gases in the proper concentration, that is 10%, or less, by volume, of sulfur-hexafluoride ($SF_6$) gas with the remaining being made up substantially entirely of helium.

22 Claims, 15 Drawing Figures

UNIFORM FIELD BREAKDOWN IN $N_2/SF_6$ GAS MIXTURES

D.C. BREAKDOWN IN 1 CM. POINT - PLANE GAP FOR STATIC GAS, AND FOR FLOW AT ~30 M/S TOWARDS THE POINT ELECTRODE

EFFECT OF % $SF_6$ ON BREAKDOWN OF A ROD-ROD GAP IN $H_2$-$SF_6$ MIXTURES AT 60 P.S.I.G.

312
253
254
L1
316
316
256
250
314
282
290
282
274
273
281
He /SF6
280
GAS MIXTURE
257
283
272
291
271
269
FULLY OPENED
295
296
267
259

259
251
268
270
269
L2
260
268
267
266
265
264
262
261
OPERATING MECHANISM

GAS-TYPE CIRCUIT-INTERRUPTERS HAVING ADMIXTURES OF HELIUM WITH SMALL CONCENTRATIONS OF SULFUR-HEXAFLUORIDE ($SF_6$) GAS

CROSS-REFERENCE TO RELATED APPLICATIONS

Applicant is not aware of any related patent applications pertinent to the present invention.

BACKGROUND OF THE INVENTION

In U.S. Pat. No. 2,757,261, issued July 31, 1956, to Harry J. Lingal, Thomas E. Browne, Jr., and Albert P. Strom, there are illustrated and described various types of circuit-interrupting structures, of both the puffer-type, and also the gas-storage type, utilizing as the arc-extinguishing gas sulfur-hexafluoride ($SF_6$) gas under suitable pressures. This patent, additionally, suggests the admixtures of other gases, for example, stating that while the inventors have secured the best results with an arc-interrupting gas composed of sulfur-hexafluoride ($SF_6$) alone, small quantities of one or more other gases may be admixed therewith, over 50% of the gas, preferably, being sulfur-hexafluoride gas. Moreover, the aforesaid U.S. Pat. No. 2,757,261 suggests, as examples of such added gases, air, nitrogen, hydrogen, argon, helium, and carbon dioxide gases. Moreover, said patent, on column 16 thereof, states that in FIG. 19 of said patent the interrupting performance of a mixture of 50% air and 50% sulfur-hexafluoride gas at two voltages, namely, 2,300 volts, and 13,800 volts, compared with the performance of 100% sulfur-hexafluoride gas at 2,300 volts and 13,800 volts. From these curves, the aforesaid patent states that it is apparent that even with air mixed with an equal amount with the sulfur-hexafluoride gas, nevertheless beneficial results are obtained, and the performance is considerable better than that with 100% air.

It has been well known by those skilled in the art that certain manufacturing companies, such as the Westinghouse Electric Corporation and the ITE Imperial Company, have manufactured commercial circuit-interrupters, utilizing exclusively sulfur-hexafluoride ($SF_6$) gas, as not only the arc-extinguishing medium, but, in certain instances, utilizing the same ($SF_6$) gas, namely sulfur-hexafluoride gas, as the operating medium to effect operation of the separable contact structure as well as effecting an arc-extinguishing gas flow to extinguish the arc. An example of a high-power piece of equipment utilizing sulfur-hexafluoride gas to advantage, utilizing a double break within a single circuitbreaker module, reference may be had to U.S. Pat. No. 3,291,947, issued Dec. 13, 1966, to R. C. Van Sickle and assigned to the assignee of the present invention.

BRIEF SUMMARY OF THE INVENTION

An improved gas-type circuit-interrupting structure is provided utilizing as the arc-extinguishing gas an admixture of helium gas and sulfur-hexafluoride ($SF_6$) gas, with the percentage concentration, by volume, of the sulfur-hexafluoride gas being 10%, or less. By the use of such an admixture of gases in the foregoing percentage concentrations, considerable advantage is achieved not only by a cost reduction of the utilized helium gas, but also by the ability to utilize the ambient gas pressure at a much higher gas-pressure level than would be possible, utilizing sulfur-hexafluoride ($SF_6$) gas alone, which would encounter somewhat serious liquefaction problems at low ambient temperature levels. As a result, the use of heaters, and other means for preventing the liquefaction of the sulfur-hexafluoride ($SF_6$) gas, when it is used in the pure state, are obviously avoided.

The improved helium-sulfur-hexafluoride gas mixture of the present invention, utilizing relatively small traces of sulfur-hexafluoride ($SF_6$) gas, with the helium gas, may be utilized in various forms of circuit-interrupters. For example, a circuit-interrupter of the well-known "puffer-type" may be utilized to advantage, wherein the gas flow is achieved by relative motion of an operating cylinder, carrying, for example, the movable contact structure and moving over a relatively-stationary piston structure, compressing gas within the operating cylinder volume, and forcing said gas, under pressure, through a suitable movable nozzle, or orifice structure, in which the established arc is drawn. As well known by those skilled in the art, such a generated gas flow, passing through the hollow orifice, or nozzle structure, causes intimate engagement of the admixed gas with the established arc therein, itself passing centrally through the said orifice structure, thereby effecting its rapid extinction.

DESCRIPTION OF THE PREFERRED EMBODIMENTS

Figure 1:
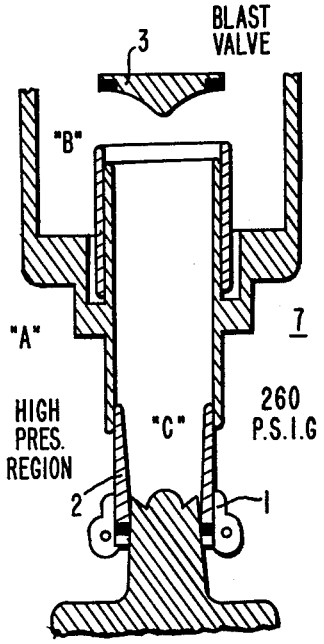
FIG. 1 shows a somewhat diagrammatic representation of a double-pressure, gas-type circuit-interrupting structure, utilizing "primary" and "secondary" blast-valves, of a well-known commercial structure with the separable contact structure being shown in the closed-circuit position.
Figure 2:
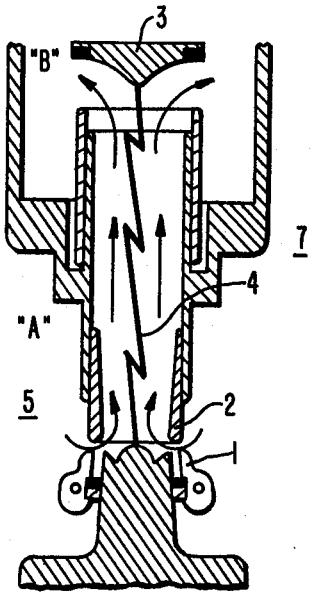
FIG. 2 is a view, also diagrammatic in nature, and illustrating the establishment of the arc at a later time, drawn between the electrode structures, when separated, during the opening operation.
Figure 3:
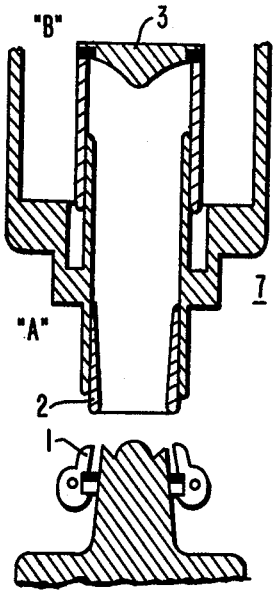
FIG. 3 illustrates the conditions at a later point in time the fully-open-circuit position of the interrupter, with the secondary blast-valve closed, and high-pressure gas existing between the separated contact structure, thereby holding the impressed voltage.

In a gas-blast circuit-breaker, the sequence of operations is as shown in FIGS. 1–3. When it is required to interrupt power flow in order to isolate a line fault, or to switch a section of a power system, the separable contacts are opened, and a gas blast is initiated. The gas blast provides a means of heat removal and when the alternating current next goes through a current zero, arc interruption is assisted by the gas blast.

In more detail, FIGS. 1–3 illustrate a particular type of gas-blast circuit-interrupter of the type set forth in U.S. Pat. No. 3,596,028, issued to Kane et al on July 27, 1971, and assigned to the assignee of the instant patent application. In general, such a type of gas-blast circuit-interrupter, as illustrated and described in detail in the aforesaid Kane et al. U.S. Pat. No. 3,596,028, utilizes high-pressure gas, say, for example, 260 p.s.i.g. in the region "A" externally of the separable contacts 1,2. In the downstream region "B", which is normally at relatively low gas pressure, say, for example, 10 p.s.i.g., for example, there is provided a secondary blast-valve, designated by the reference numeral 3. In the fully-closed-circuit position of the circuit-interrupter, as illustrated in FIG. 1, the secondary downstream blast-value 3 is open to thereby permit free communication between the downstream relatively low-pressure region "B", and the interior region "C" within separated contact structure, as illustrated in FIG. 1.

As set forth in the aforesaid Kane et al. patent, certain operating means, not disclosed herein, are operable to effect upward opening separating motion of the movable tubular venting exhausting contact 2 away from the lower-disposed relatively-stationary contact 1, drawing an arc, designated by the reference numeral 4, within the interior of the separable contact structure 5, as illustrated more clearly in FIG. 2.

When this separating contact motion occurs, thereby opening the "primary" blast-valve constituted by the separable contacts 1,2 themselves, high-pressure gas flows radially inwardly from the high-pressure gas-region "A" radially inwardly between the separated contacts 1,2, to exhaust upwardly past the secondary blast-valve 3, and into the relatively low-pressure region "B". Such arc establishment and gas-flow conditions are illustrated in FIG. 2 of the drawings herein.

Suitable means, not disclosed herein, but which is set forth in detail in the aforesaid Kane et al. U.S. Pat. No. 3,596,028, effect closing of the secondary blast-valve 3 in the manner set forth in FIG. 3 of the drawings herein, thereby closing off the downstream low-pressure region "B" from the high-pressure gas region "A" externally of the fully-open separated contact structure, as illustrated in FIG. 3 of the drawings. For certain high-voltage applications, a plurality of such arc-extinguishing units 7 may be employed in electrical series, as well known by those skilled in the art, and the respective movable contacts of the serially-related arc-extinguishing units 7 arranged for simultaneous operation by a common mechanism. In addition, for additional ratings, the relatively-stationary contact structure 1, instead of being "blocked off", as illustrated in FIGS. 1–3, may, itself, by constituted by a relatively-stationary hollow venting contact (not shown), which provides an additional opposite venting flow, similar to the exhausting flow illustrated in FIG. 2, but, in fact, occurring through the "hollow" vented stationary contact 1. Such structures, are, in fact, set forth in the aforesaid Kane et al. patent application.

Figure 4:
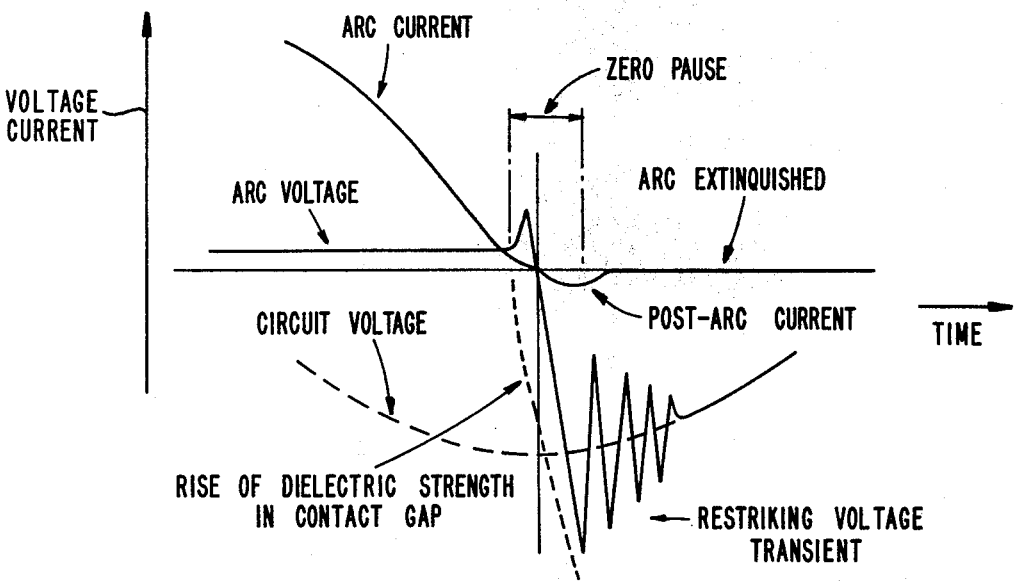
FIG. 4 illustrates curves of the current and voltage near current zero for a successful arc interruption.
Figure 14:
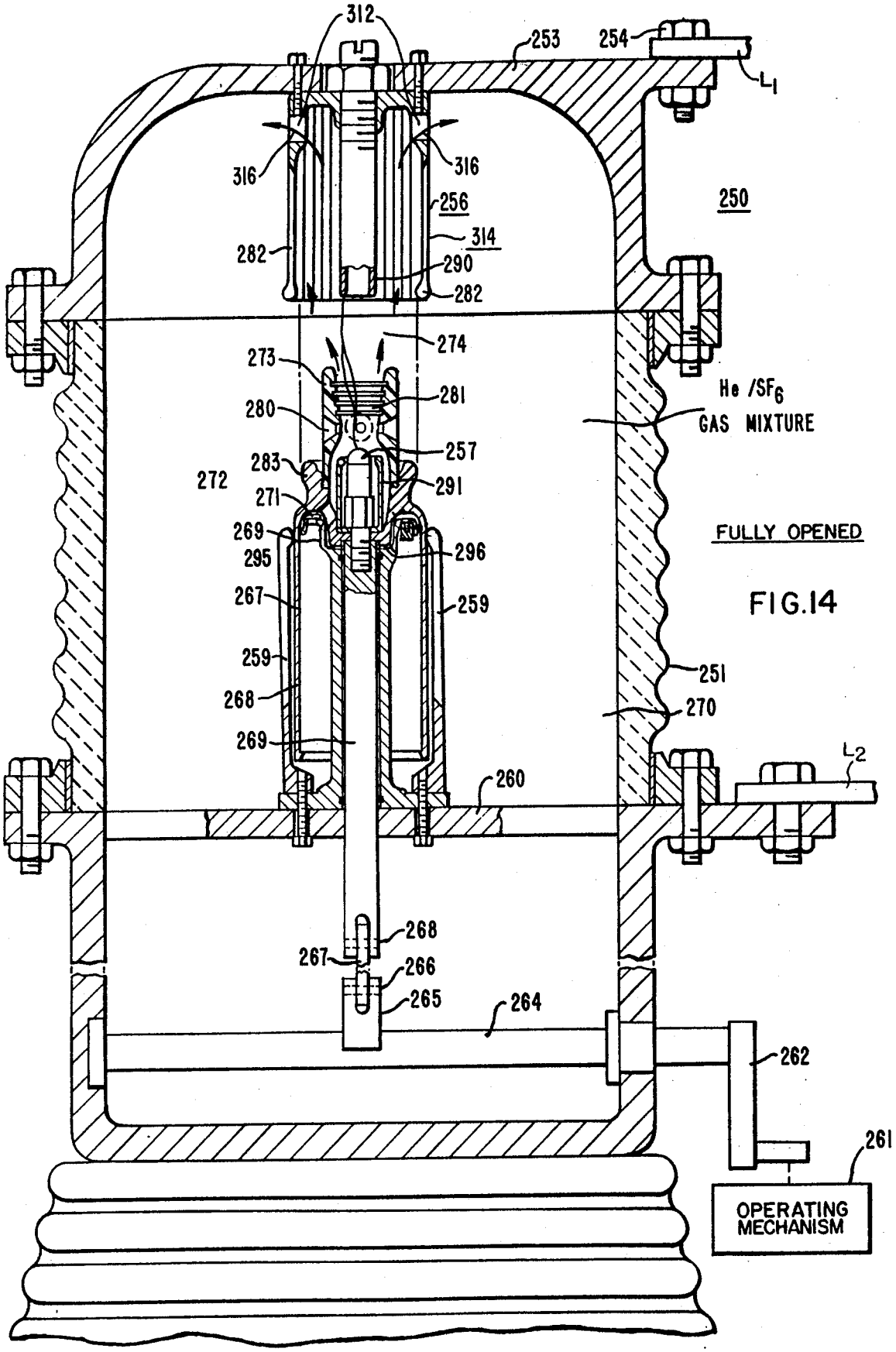
FIG. 14 illustrates a vertical sectional view taken through a commercial-type of "puffer" circuit-interrupter, utilizing the improved gas admixture of the present invention under a suitable ambient pressure, with the contact structure being illustrated in the fully-open-circuit position.

The sketch of FIG. 4 shows the variation of the transient current and voltage near current zero. After interruption, the gas stream must be able to withstand a transient voltage surge, and after steady-state conditions are restored, the gap between the contacts 1 and 2 must withstand the normal operating voltage of the system. Two-pressure gas-blast circuit-breakers are of two types: in air-blast breakers, compressed air is used as the interrupting medium. These generally operate with high-pressure air (~500 p.s.i.) and have a simple system, where the air is exhausted to the atmosphere. In $SF_6$-blast circuit-breakers, sulfur-hexafluoride gas is used in a two-pressure system, where the gas is stored at ~250 p.s.i., for example, and is blasted through the arc chamber to a low-pressure gas reservoir container. $SF_6$ gas is used because of its superior dielectric strength (the breakdown voltage of a given gap in $SF_6$ being ~3 times that for the same gap in air at the same pressure), and because of its good thermal properties. $SF_6$ circuit-breakers are quieter and more compact than air-blast circuit-breakers, can more easily handle high-fault power, and are compatible with modern $SF_6$ gas-insulated transmission lines and also metal-clad substation components. Puffer-type interrupters may also use the principles of interruption set forth herein, as shown in FIG. 14 and discussed hereinafter.

Those skilled in the art know that there is little correlation between the dielectric strength of a gas and its ability to interrupt electric arcs. For example, hydrogen has approximately half the dielectric strength of air, but hydrogen gas will interrupt arcs of several times the amperage that air will under the same test conditions. However, it is essential that a gas should have adequate dielectric strength to withstand the system voltage after the arc-interruption function has been completed. While helium gas has a small time constant in free-recovery conditions, it fulfills neither the interruption, nor the dielectric-withstand requirements in gas-blast conditions. I have discovered that mixtures of helium gas with small quantities of (sulfur-hexafluoride) ($SF_6$) gas can fulfill both requirements, in that the arc-interrupting properties can be as good as pure sulfur-hexafluoride ($SF_6$) gas, while the dielectric strength can be adequate to withstand the required A.C. voltage after interruption.

It is proposed in the present invention to exploit the use of low-$SF_6$ concentration mixtures for circuit-breaker applications by using a gas, such as helium, which has excellent thermal properties, with the addition of a small amount, up to 10% by volume, of $SF_6$ gas. Helium gas alone is of no interest for gas-blast circuit-breakers because of its very low dielectric strength (<5% of that of $SF_6$ gas). The addition of $SF_6$ gas is expected to improve the dielectric strength properties in the manner shown in FIGS. 6 and 7. Further, with regard to the arc-quenching properties of the gas, the addition of $SF_6$, a molecular gas with a large number of mechanisms for absorbing energy from electrons, should assist in providing good thermal contact between the electrons and the gas, so that, as the current approaches current zero, the electron density and electron energy should fall faster than in helium alone. Thus, the high thermal diffusivity of the He, combined with the properties of $SF_6$, which promote arc-core formation, may produce a lower arc-time constant in $SF_6$/He gas mixture, than for either gas alone. A major advantage of the helium-rich mixture, as compared to $SF_6$ gas, is the higher sonic velocity in the helium-rich mixture, which will result in stronger turbulent penetration and arc-cooling near current zero.

Dielectric Strength of Gas Mixtures

Figure 5:
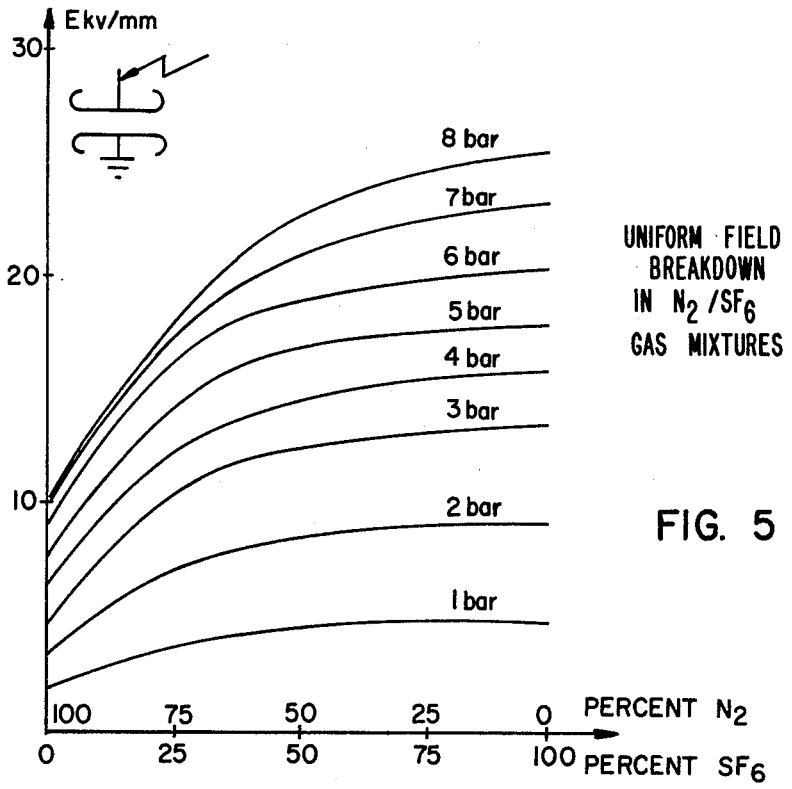
FIG. 5 illustrates curves for uniform field breakdown in $N_2/SF_6$ gas mixtures.

Most of the available measurements of the dielectric strength of gas mixtures have been made for relatively uniform-field electrode geometries (see, for example, the paper by Takuma, Watanabe and Kita, Proc. IEE, 119, pp. 927–8, 1972). FIG. 5 shows data from the above paper for $N_2/SF_6$ mixtures. It can be seen that ~30% $SF_6$ is required to obtain an improvement of 100% over the dielectric strength of nitrogen. Such behavior will always be observed if the field is relatively uniform (i.e. if the ratio of the maximum electric field in the gap to the average field is less than ~4/1). For such electrode geometries, electrical breakdown is not usually preceded by corona.

For more non-uniform-field electrode configurations, for example, with the rod-rod electrodes typical of circuit-breaker applications, the dependence of the dielectric strength of the gas on $SF_6$ content is much more marked, especially for low $SF_6$ concentrations.

Figure 9:
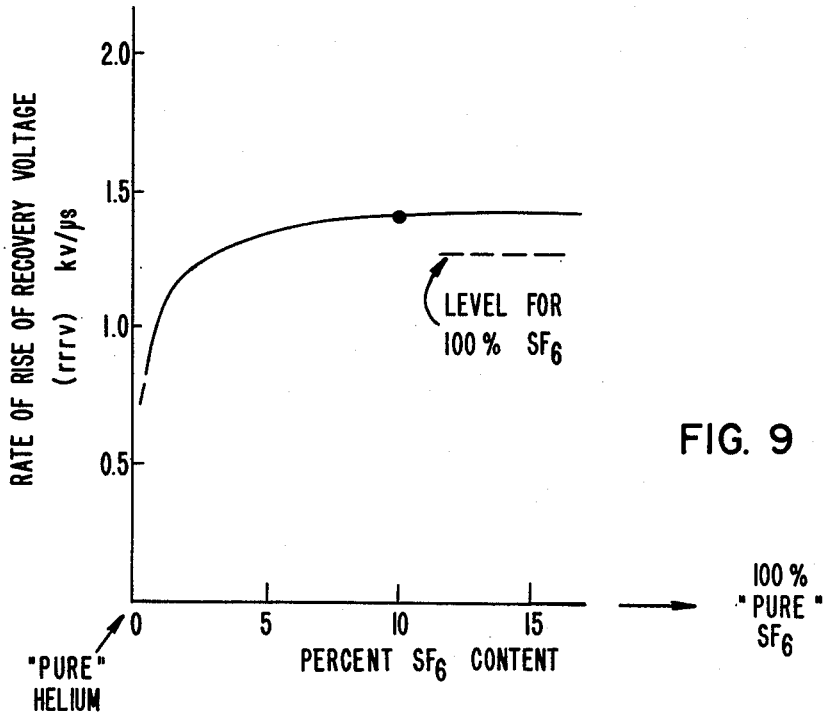
FIG. 9 illustrates a curve, indicating the rate of rise of recovery-voltage transient as a function of $SF_6$ content, or concentration, for helium/$SF_6$ gas mixtures, for an upstream pressure of 6 atmospheres.
Figure 6:
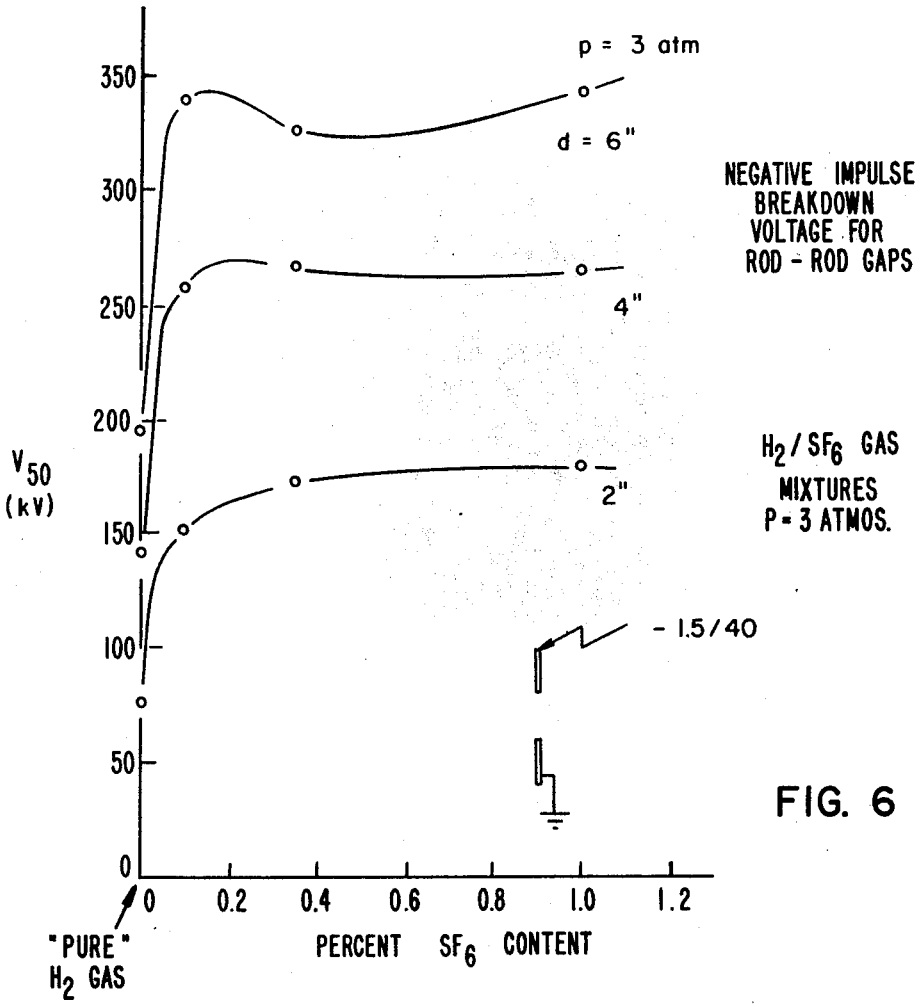
FIG. 6 shows curves of negative impulse breakdown voltages for rod-rod gaps in $H_2/SF_6$ gas mixtures at 3 atmospheres, with negative impulses, also for gaps of 2 inches, 4 inches, and 6 inches.
Figure 7:
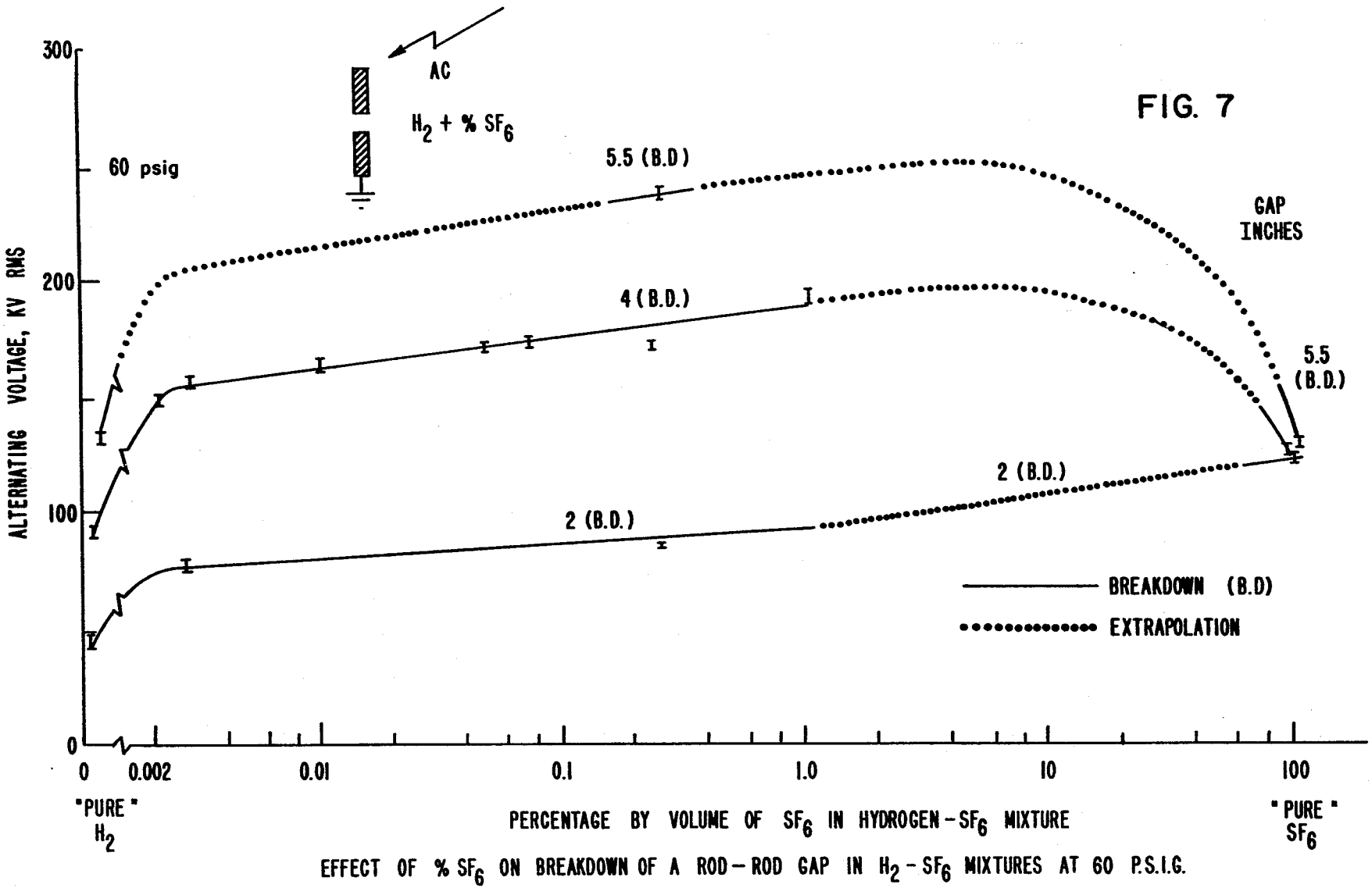
FIG. 7 show curves of the effect of percentage $SF_6$ on AC breakdown of rod-rod gaps in $H_2/SF_6$ gas mixture at 60 p.s.i.g.

FIGS. 6 and 7 show data for impulse and AC breakdown for rod-rod gaps in hydrogen/$SF_6$ mixtures, and FIG. 9 shows data for $N_2/SF_6$ mixtures for a point-plane gap.

In FIG. 6, it can be seen that the addition of very small amounts of $SF_6$ to hydrogen gives a marked improvement in the impulse breakdown strength: for a 6 in gap, for example, the breakdown voltage at 3 bar (30 p.s.i.g.) is increased by ~80% with the addition of only 0.08% $SF_6$ to hydrogen.

FIG. 7 shows the behavior for AC voltages on rod-rod gaps in hydrogen/$SF_6$ mixtures. It can be seen that there is an initial rapid improvement with only ~0.003% $SF_6$, and that, for a 5.5 inch gap, the strength with ~1% $SF_6$ is 100% greater than pure $SF_6$ at a pressure of 60 p.s.i.g. Although the 2 inch gap in FIG. 7 does not show the advantage over pure $SF_6$ demonstrated for the longer gaps, it should be remembered that the dielectric strength in $SF_6$ mixtures is a strong function of the degree of non-uniformity of the field; similar characteristics could, therefore, be achieved for shorter gaps by appropriate choice of electrode profile.

Figure 8:
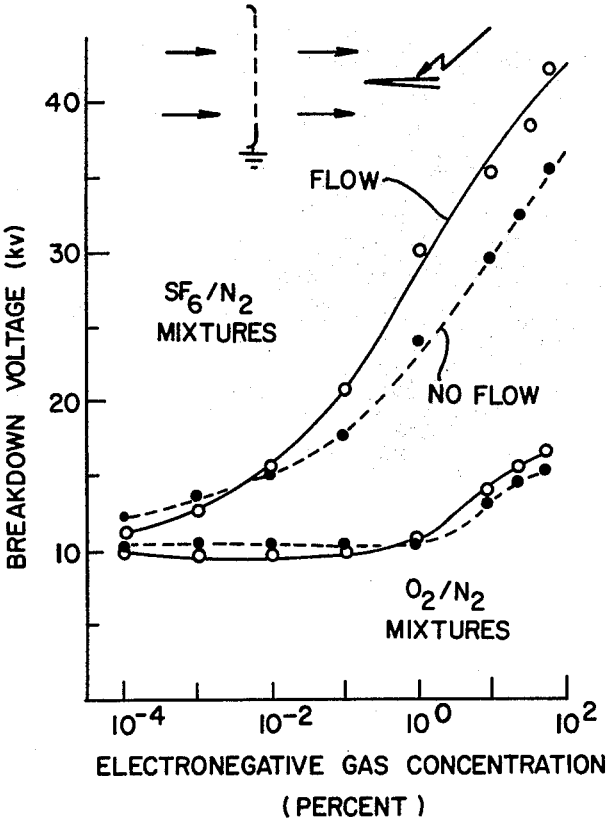
FIG. 8 illustrates curves of DC breakdown in 1 cm. point-plane gaps.

FIG. 8 shows DC breakdown voltages in $SF_6/N_2$ mixtures for a 10 mm point-plane gap in static and flowing gas. With gas flow at 30 m/s, the breakdown voltage increases from ~10 K.V. for "pure" $N_2$ to ~30 K.V. with 1% $SF_6$ and 35 K.V. with 10% $SF_6$ compared to ~40 K.V. for pure $SF_6$.

Thus, for non-uniform-field electrodes, typical of circuit-breaker configurations, the dielectric strength of $SF_6$ mixtures is higher for low-$SF_6$ concentrations than would be expected on the basis of the well-known uniform-field measurements in mixtures. As the uniform-field strength of helium is ≦5% of that of $SF_6$ at a given pressure, this highly non-linear behavior in non-uniform fields is important in raising the dielectric strength of low-$SF_6$ concentration mixtures up to an adequate level.

Gas-Blast Circuit Interruption In Gas Mixtures

The initial tests on the arc-interruption in $SF_6$/He mixtures were made with a test circuit-breaker, whose performance under air-blast conditions was known. In these tests, helium with 1% $SF_6$, by volume, was shown to be capable of interruption under test conditions where the arc current and voltage were both twice the values for which the test breaker had failed in air at the same upstream pressure level. This performance is roughly that which would be found for pure $SF_6$ gas for high-pressure, gas-blast conditions, and suggests that a 1% $SF_6$/He mixture is considerably better than air, and nearly as good as $SF_6$, in the test circuit-breaker.

The test plant arrangement for these tests was as follows: A capacitor bank (60 μF; 15 K.V. max. charge) was used with a 1.68 mH tuning inductance to give a 500 Hz test frequency and 5.3Ω equivalent impedance (i.e. 2.8 K.A. max. peak current $dI/dt$ max = 8.9 $A/\mu s$). The transient recovery frequency was 10 KHz, and the TRV was a (1-cosine) undamped wave. The recovery voltage peak was ~1.8 times charge voltage.

With this test method, the charge voltage is varied until failure occurs. The system has been used for air-blast studies and comparative data for air was available. The tests were made at upstream pressures of 100 p.s.i.g., 60 and 45 p.s.i.g. A 1% $SF_6$, 99% He mixture was tested:

At 100 psig—no failure was observed up to full charge voltage (i.e. cleared at 8, 10, 12 and 15 K.V.).

At 60 psig—the mixture cleared 6 K.V., 10 K.V., and failed at 12 K.V. (i.e. 50% recovery roughly 11 K.V.).

At 45 psig—the mixture cleared 6 K.V., 8 K.V., failed 10 K.V. (i.e 50% recovery ≃9 K.V.).

This may be compared with air data as indicated:

| Pressure | Charge Voltage for 50% Recovery | |
|---|---|---|
| psig | 1% $SF_6$/He | Air |
| 100 | >15 K.V. | 8 K.V. |
| 60 | ~11 K.V. | ~6 K.V. |
| 45 | ~ 9 K.V. | — |

As current and voltage are directly related in this test, the mixture is able to interrupt with twice the voltage and twice the current that can be achieved with air-blast.

Some considerable time after the original conception of the potential usefulness of He/$SF_6$ mixtures, and the above preliminary test, further arc-interruption studies were carried out in He/$SF_6$ mixtures. These trials were made in the same test circuit-breaker, using a different test circuit, and included an evaluation of the performance of pure $SF_6$ gas in the test breaker.

The test system used was the so-called "direct synthetic test method". The test current was 1.7 K.A. peak at 1 KHz, and the current zero $di/dt$ of 9A/μs corresponded to a 50 Hz current peak of ~30 K.A. The breaker was tested by varying the rate of rise of recovery voltage (*rrrv*) and determining the critical rrrv for 50% recovery.

FIG. 9 shows the performance achieved with $He/SF_6$ mixtures at an upstream pressure of 75 psig. For a 10% $SF_6$, 90% He mixture, for example, the rrrv was 1.4 K.V./μsec., compared with a level of 1.25 K.V./μsec. with 100% $SF_6$ gas in the same circuit-breaker at the same upstream pressure.

Tests with nitrogen/$SF_6$ mixtures at the same concentration (10% $SF_6$) gave a value of only 0.35 K.V./μsec., for the critical rrrv. This demonstrates further the excellent properties of $He/SF_6$ gas mixtures for low $SF_6$ gas concentrations.

Thus, the invention comtemplates the use of gas mixtures containing $SF_6$ gas in small quantities (always $\leqq$ 10%, by volume) as an arc interrupting medium. The exact proportion of $SF_6$ to be used will depend on the pressure range and on the electrode profile. In the preferred embodiment, the bulk gas would be helium, but other gases may be used, if their thermal characteristics were adequate, and if there were no severe problems due to the formation of undesirable compounds with the products of dissociation of $SF_6$ gas under arcing conditions.

Figure 10:
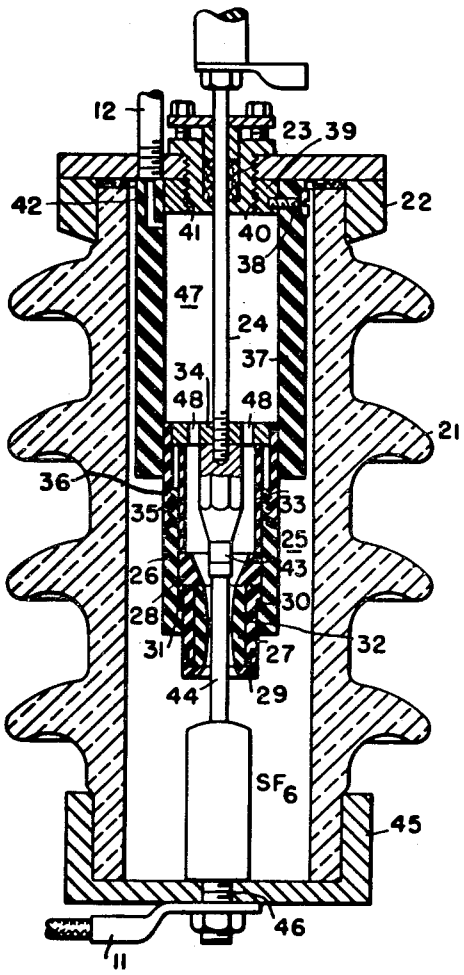
FIG. 10 illustrates a puffer-type circuit-interrupter, with the contact structure being illustrated in the closed-circuit position.

FIG. 10 indicates a circuit-interrupter using $He/SF_6$ gas mixture 21 and employing a piston 22 movable with the movable contact 23 for causing forced gas flow against or through the drawn arc 25. This is known as a "puffer" type of circuit-interrupter. The reference character 21 indicates a porcelain cylinder having a perforated top end cap 22 having a bushing 23, through which a movable contact rod 24 moves, under the influence of a mechanism (not shown), externally of the bushing 21.

Secured to the movable contact rod 24 is a piston, generally designated by the reference character 25, and including an insulating cylinder 26. An orifice member 27 of polytetrafluoroethylene, for instance, is disposed at one end of piston 25, being retained in place between a washer-shaped member 28 and an insulating cap 29. An internal shoulder 30 is provided at the lower end of the insulating cylinder 26 against which an outwardly turned flange 31 of a tubular member 32 is placed. The cap 29 is threadedly connected to the lower end of the insulating tube 32.

Spacing the upper side of the washer member 28 from the top of the piston 25 is an insulating spacing sleeve 33, having the upper end thereof bearing against an apertured plate 34 having apertures 48 therein. The bottom side of the washer member 28 abuts the insulating tube 32 and holds it against the shoulder 30.

The insulating cylinder 26 is threadedly connected, at 35, to an insulating cylindrical extension 36, which extension is secured, as by threading or by a press fit, as shown, to the apertured plate 34.

The piston 25 slides within a space 47 in a cooperating cylinder 37, the upper end of which is secured by one or more screws 38 to a conducting washer 39, threadedly engaged at 40 to a metallic bushing 41. The operating cylinder 37 has a channel 42 provided therein to register with a conduit 12, the latter being provided to allow introduction of $He/SF_6$ gas to the interior of the casing 21. The lower end of the movable contact rod 24 carries a movable contact 43, which makes abutting engagement, as shown, with a stationary contact member 44, the latter being secured to an apertured lower end plate 45 closing the lower end of the casing 21. A line terminal 11 is secured to an extension 46 of the stationary contact member 44.

The operation of the breaker of FIG. 2 is as follows: During the circuit opening operation, the movable contact rod 24 is moved upwardly by a suitable external actuating mechanism not shown. The upward movement of the movable contact rod 24 not only effects separation between the contacts 43, 44 drawing an arc therebetween, but also moves the piston 25 within the interior of the operating cylinder 37, thereby causing the $He/SF_6$ gas within the space 47 to pass through the apertures 28, provided in the plate 34, and interiorly through the piston 25 and thence through the orifice member 27 where the flow of $He/SF_6$ gas is constricted into engagement with the arc. The flowing stream of $He/SF_6$ gas enables a prompt and efficient extinction of the arc.

Figure 11:
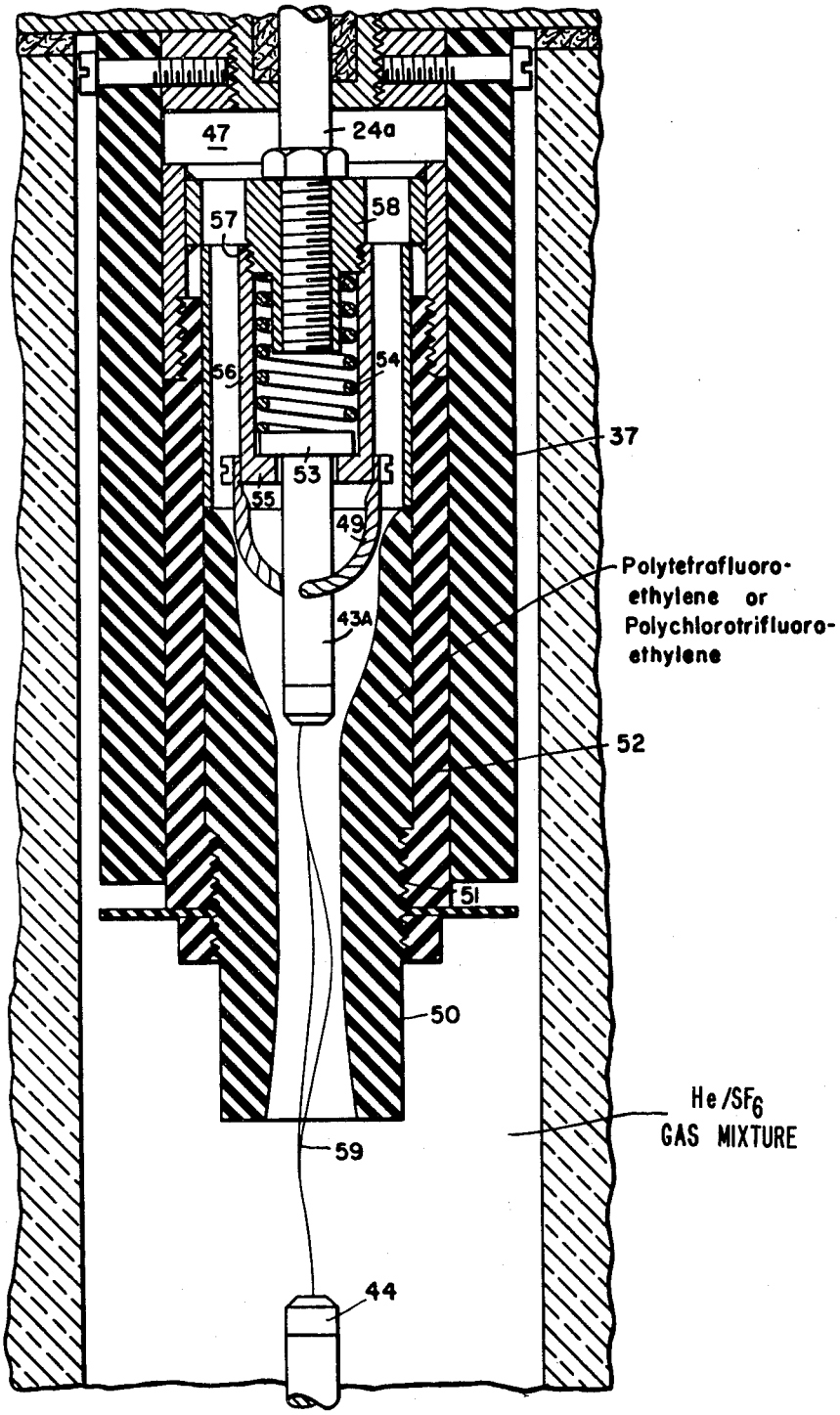
FIG. 11 is a considerably-enlarged view of the internal contact structure of FIG. 10, with the arcing conditions being illustrated.

An improved piston arrangement over the one shown in FIG. 2 is shown in FIG. 11, an orifice member 50 of polytetrafluoroethylene, for example, is threaded at 51, to engage matching threads at the lower end of piston 52. The orifice member 50 is considerably longer than the orifice member in FIG. 2. It will be observed that a movable contact 43A, having a cap 53, is resiliently mounted, with a compression spring 54 biased downwardly against the cap 53, which is supported on an interiorly extending flange portion 55 provided at the lower end of a conducting cylinder 56. The upper end of the cylinder 56 is threadedly connected at 57 to an apertured spider portion 58 threadedly connected to the movable contact and piston rod 24*a*. Flexible pigtails 49 fastened to the cylinder 56 and the contact member 43A provide for flow of current to the contact member at all times.

The piston arrangement shown in FIG. 11 has advantages as far as orifice construction is concerned by directing for a longer time the $He/SF_6$ gas flow against the arc 59 drawn between the stationary contact 44 and the movable contact 43A. However, the fundamental method of operation, namely, of providing a forced gas flow from the region 47 through the piston and against the arc 59 is the same as that shown in FIG. 2.

Figure 12:
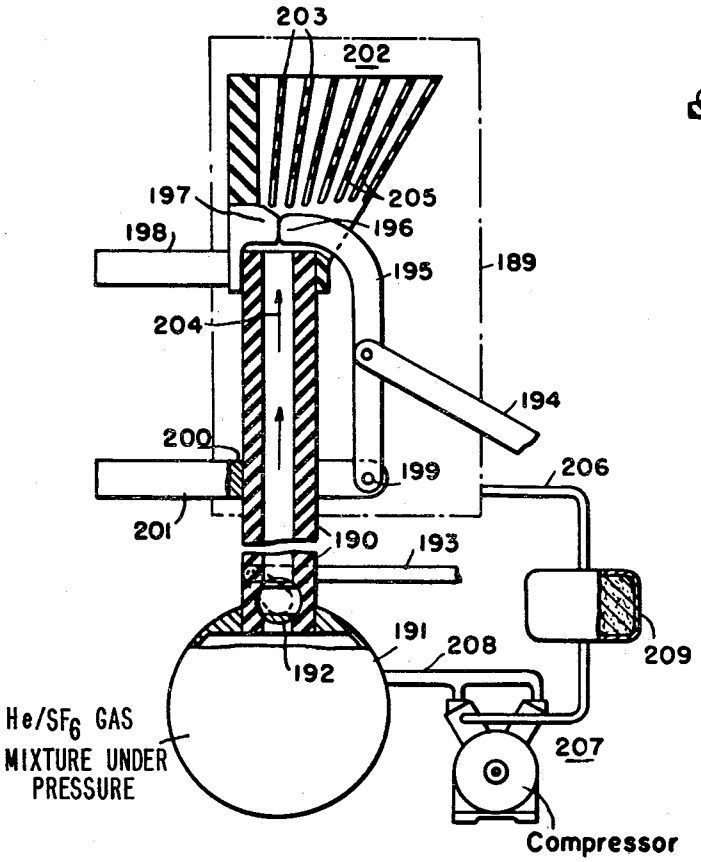
FIG. 12 illustrates a type of circuit-interrupter using the improved gas admixture of the instant invention, utilizing a gas-reservoir tank, with a blast-valve for forcing the gas mixture between the separated contacts, and through insulating splitters in a generally circulating gas system, with the contact structure being illustrated in the closed-circuit position.

FIG. 12 represents an embodiment of our invention comprising a gas-blast breaker utilizing $He/SF_6$ gas stored under pressure, and the breaker having an enclosure 189 provided for preventing escape of the $He/SF_6$ gas during the interrupting operation. A blast tube 190 enters the enclosure 189 at the lower end thereof, being connected to a reservoir tank 191 containing the $He/SF_6$ gas, preferably under pressure. A blast valve 192 is provided, being operable by an actuating link 193, which may be operated in synchronism with opening motion of an operating rod 194 connected to a pivotally mounted movable contact arm 195. At the upper extremity of the movable contact arm 195 is a movable contact 196 cooperable with a stationary contact 197. The latter is connected to a terminal stud 198 passing through the enclosure 189, and to which an external line connection may be made.

The movable contact arm 195 is pivotally connected, at 199 to a bifurcated bracket 200, the latter protruding externally of the enclosure 189 to form a second terminal stud 201, to which likewise a line connection may be made.

Associated with the movable and stationary contacts 196, 197 is an arc chute, generally designated by the reference character 202, and including a plurality of slotted insulating arc splitter 203. A blast of $He/SF_6$ gas passing upwardly through the interior of the blast tube 190, upon opening motion of the blast valve 192, as indicated by the arrows 204, will effect an upward blasting action upon the arc established between the contacts 197, 196, forcing this arc upwardly into the slots 205 of the arc splitters 203 effecting rapid extinction thereof. The He/$SF_6$ gas which exhausts out of the arc chute 202 into enclosure 189 is drawn through a conduit 206 into a compressor 207 where it is put under pressure and returned by way of a conduit 208 to the reservoir 191, where it may be subsequently used in later interrupting operations. To protect the closed system against corrosive gases which may be produced by the action of the arc on the He/$SF_6$ extinguishing medium, a chamber 209, containing an absorbing substance such as activated alumina, activated carbon, or silica gel, may be serially inserted in the gas circulating system.

Thus, FIG. 12 shows an application of the use of sulfur hexafluoride gas under pressure to take the place of air, which is customarily used in compressed air breakers, but instead of letting the gas escape and be lost, as is done with the compressed air in compressed air breakers, in our interrupter, as shown in FIG. 12, the gas is saved and recompressed in the compressor 207 to be used over and over again.

Figure 13:
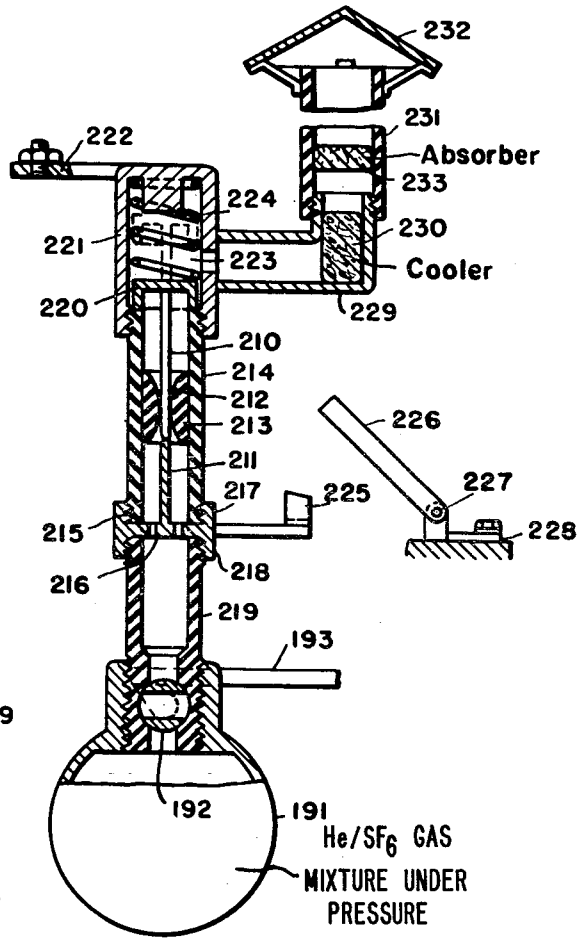
FIG. 13 illustrates a modified-type of circuit-interrupter, again using a gas-reservoir chamber containing the gas admixtures under considerable pressure, with the admixed gas being exhausted to the atmosphere following its use, the contact structure being of the spring-biased-closed type, and opened by gas pressure.

In the embodiment of our invention illustrated in FIG. 13, we show an axial blast circuit interrupter having certain features identical to those previously disclosed in connection with the gas blast breaker of FIG. 9. Thus a reservoir tank 191 containing He/$SF_6$ gas under pressure, is utilized. Also, a blast valve 192 operated by an actuating link 193 is provided, as was the case in the interrupter of FIG. 12.

It will be noted, however, that in the interrupter of FIG. 13, the arc, which is established between a movable contact 210 and a stationary contact 211, is drawn axially through the bore 212 of an insulating orifice member 213. The contact 210 is slightly spaced from the walls of the orifice member 213 to permit He/$SF_6$ gas to pass by. The orifice member 213 may be secured by a press fit within an insulating blast tube section 214, the lower end of which is threadedly secured, as at 215, to a conducting perforated spider 216. The conducting spider 216 has upper and lower flange portions 217, 218 which are respectively secured to the blast tube section 214 and to a lower blast tube section 219.

It will be observed that the movable contact 210 is affixed to a piston 220 which moves axially within a conducting operating cylinder 221, at the upper end of which is secured a line terminal 222. The operating cylinder 221 has an opening 223 which is uncovered upon sufficient upward movement of the piston 220. A compression spring 224 is provided to bias the piston 220 downwardly, and hence the contact structure, to the closed circuit position.

Associated with the conducting spider 216 is a stationary disconnect contact 225 cooperable with a movable disconnect blade 226, the latter being rotatably mounted, as at 227, on a terminal plate 228, to which a line connection may be made.

The exhaust opening 223 leads into a chimney 229 within which is disposed a cooler 230 consisting of copper wool, or other cooling material. The chimmey 229 has an upper insulating section 231 associated therewith which may extend upwardly through the roof of the building, in which the interrupter is utilized. A rain shed 232 may be secured to the upper end of the chimney extension 231 to prevent rain, snow, or sleet from falling within the interior of the chimney extension 231.

As was the case with the interrupter of FIG. 12, we provide an absorber 233 for removing any corrosive gases that might have been formed as a result of the arc reacting upon the He/$SF_6$ gas. Activated alumina may, as an example, be used in the absorber.

The operation of the interrupting device is as follows. Upon opening the blast valve 192 by operation of the actuating link 193, He/$SF_6$ gas under pressure passes upwardly through the blast tube section 219, past the spider 216, and through the orifice member 213 to act upwardly upon the movable piston 220. When the gas pressure below the piston 220 is sufficient to raise it, in opposition to the biasing action exerted by the compression spring 224, the contacts 210, 211 will become separated and will draw an arc axially through the bore 212 of the insulating orifice member 213.

The blast of He/$SF_6$ gas passing upwardly through the orifice member 213 will rapidly extinguish the arc drawn between the contact structure, and the gas will exhaust outwardly through the exhaust opening 223 which will have been uncovered at this time by upward displacement of the piston 220. Any arc flame will be cooled by the copper wool within the cooler 230, and any corrosive gases will be absorbed in the absorber 233. The remaining gas will be exhausted to atmosphere out through the upper extension 231 of the chimney.

In order to maintain the electrical circuit open upon closure of the blast valve 192, the serially related disconnect switch 225, 226 is provided. Thus upon closure of the blast valve 192, the compression spring 224 will effect closure of the contact structure, and the disconnect switch blade 226 may be maintained in its open position to cause the electrical circuit to remain open even though the contact structure within the interrupter has been closed.

Thus, in this embodiment of our invention we show an application of the use of He/$SF_6$ gas under pressure in an axial blast type of circuit interrupter, in which the He/$SF_6$ gas mixture may be freely exhausted to atmosphere through a suitable provided chimney, the latter leading up, for instance, through the roof of the building which houses the interrupter.

The advantages of $SF_6$-helium mixtures for circuit-breaker applications include the following:

(1) There should be an improvement in the cost of the gas for the circuit-beaker, as helium gas should be cheaper than $SF_6$ gas. This is a relatively minor advantage.

(2) A major advantage would be the possibility of designing circuit-breakers to operate at higher upstream pressures. The maximum pressure at which it is possible to operate with pure $SF_6$ is restricted, because of the liquefaction of the gas at pressures of around 300 lbs. per square inch guage. With $SF_6$-helium, and particularly with mixtures having concentrations of $SF_6$ less than 10 percent, the liquefaction pressure would be so high as to present no problems in this regard. A concomitant advantage would then be that for breakers operating at around the present maximum pressures of, say 300 psi gauge, which are used for $SF_6$, there would be no requirement for gas heaters, which are presently used in two-pressure breakers to avoid liquefaction of the gas in cold-climate conditions.

In the interrupting performance of helium-$SF_6$ mixtures, one of the major advantages may be that due to the much higher sonic velocity in helium, as compared with $SF_6$, this will be advantageous; and allowing rapid heat removal from the arc region, and, in fact, may offer a possibility of improved characteristics of a given interrupter with regard to nozzle clogging in such measures, as compared to $SF_6$. As already stated, one of the advantages of the $SF_6$-helium mixture is that a higher total pressure may be used in gas-blast switchgear before liquefaction occurs. This factor may be particularly important in puffer-type circuit-breakers, as many of these already operate with the maximum ambient pressures, beyond which heaters would be required to prevent liquefaction. This means that during compression, the pressure will reach levels around 250 psi gauge, which are typical of two-pressure breakers. With the $SF_6$-helium mixture, it would then be possible to operate with higher ambient pressures, say up to 150 lbs., such that the maximum pressure reached during compression would get as high as perhaps 400 lbs., but would still not result in gas liquefaction.

Referring more particularly to FIG. 14, it will be observed that there is provided a puffer-type compressed-gas circuit-interrupter 250 having an upstanding insulating casing structure 251, which is provided at its upper end with a metallic dome-shaped conducting cap portion 253, the latter supporting, by means of a bolt 254, a line-terminal connection $L_1$. Extending downwardly-interiorly of the conducting dome-shaped casting 253 within the casing 251 is a relatively stationary contact structure, designated by the reference numeral 256, and cooperable in the closed-circuit position with a movable contact structure 257. The movable contact structure 257 is electrically connected, by a plurality of sliding finger contacts 259, to a generally-horizontally-extending conducting support plate 260, which provides a second line terminal $L_2$ disposed externally of the casing 251.

A suitable operating mechanism 261 of conventional form effects rotation of an externally-provided crank-arm 262, the latter effecting opening and closing rotative motions of an internally-disposed operating shaft 264. The operating shaft 264, in turn, is fixedly connected to an internally-disposed rotative crank-arm 265, which is pivotally connected, as to 266, to a floating link 267, the latter being pivotally connected, as at 268, to the lower end of a linearly-movable contact-operating rod 269.

It will be noted that the upper end of the contact-operating rod 269 forms the movable contact structure 257 itself, which, as mentioned heretofore, makes contacting closed-circuit engagement with the stationary contact structure 256 in the closed-circuit position of the interrupting device 250, (not shown).

A movable gas-operating cylinder assembly 267 is provided having a large-diameter, downwardly-extending movable sleeve portion 268, which slidably moves over a relatively fixed piston structure 269.

During the opening operation, it will be observed that the movable operating cylinder 267 moves downwardly over the relatively fixed piston structure 269 compressing gas 270 within the region 271, and forcing it to flow upwardly through the vent openings 272 and through the movable insulating nozzle 273, through which an arc 274 is drawn.

With reference to the nozzle 273, it will be observed that there is provided a plurality, say in this particular instance four, vent openings 280 to enable the hot arc gases to quickly vent from the arcing region 281 to thereby enable a desirable cooling action to take place. Reference may be made to Telford U.S. Pat. No. 3,291,948, issued Dec. 13, 1966 in this connection.

The stationary main contact fingers 282 make contacting engagement in the closed-circuit position, with an annular main movable contact portion 283. During the opening operation of the puffer interrupter 250, the main stationary contact fingers 282 part company with the annular movable main contacting portion 283, so that thereafter contact is only maintained between the stationary tubular arcing contact 290 and movable arcing contact fingers 291.

Downward continued opening motion of the conducting operating rod 269, as effected by the operating mechanism 261, continues to force the movable operating cylinder 267 downwardly over the stationary piston structure 269, thereby providing an upward flow of compressed gas through the movable nozzle 273. It will be observed that a downwardly-extending movable boss portion 295 enters a stationary cavity 296 provided generally centrally of the relatively fixed piston structure 269 and thereby provides a mating, closing interengagement between the two structures to thereby minimize the "dead" volume of confined gas within piston space 271. This is desirable inasmuch as a higher gas-compression ratio is thereby achieved.

During the closing operation of the puffer interrupter 250, the movable gas-operating cylinder 267 moves upwardly, and carries with it the annular main movable contact 283 together with the movable arcing fingers 291. First an interengagement is made between the tubular stationary arcing contact 290 and the cluster of movable arcing fingers 291. This contacting interengagement prevents a subsequent prestriking condition occurring between the main stationary contact fingers 282 and the main annular contact portion 283. Thus, there is no arcing occurring, or permitted whatsoever at the main stationary contact fingers 282 and the annular main movable contact 283, all arcing 274 being confined to the stationary tubular arcing contact 290 and the movable arcing contact probe 300 to prevent arc erosion occurring at the main contacts.

The gas-flow path through the movable operating cylinder 267 and the movable insulating nozzle 273 presents an efficiently-shaped contour, with steadily decreasing gas-flow area reaching the minimum, or critical flow area preferably only at the nozzle throat opening **273*a***.

At the end of the opening stroke, the annular section **269*a* of the stationary piston 269 extends into the volume between the spider and the cylinder-inside diameter, continuing to compress the gas 270 into a minimum volume not otherwise obtainable. This provides for the maximum driving pressure of the gas 270 through the interrupting region 281 and the insulating nozzle 273**.

One-way-acting valve structure 301 comprising an annular ring 302, which is affixed to a plurality of circularly-spaced spring-rod portions having lower flange portions. Compression springs (not shown) are interposed between the flange portions and the boss portion of the fixed piston structure 26. Desirably, a piston ring may be provided, thereby enabling a guiding action to be obtained between the skirt portion **267*a* of the movable gas-operating cylinder 267 and the outer annular portion 269*a* of the fixed piston structure 269**.

During the upward closing operation of the interrupter 1, the annular valve-plate 302 opens and permits gas to flow into the region 271 within the movable gas-operating cylinder 268. During the downward opening compressing stroke of the gas-operating cylinder 268, on the other hand, the valve-ring closes and gas compression takes place within the region 296.

It will be noted that a plurality of circumferentially-disposed venting holes 312 are provided at the upper end of the relatively-stationary cluster main contact finger assembly 314. This provides a desired cooling action for the arcing gases which are ejected upwardly, as shown by the arrows 316. This gas may readily be ejected out of the circumferentially-spaced holes 312 disposed at the upper end of the main stationary finger casting 314.

Certain details of the construction set forth in FIG. 14 are set forth and claimed in U.S. patent application Ser. No. 616,703, filed Sept. 25, 1975 by J. R. Rostron et al. and assigned to the assignee of the instant patent application.

Figure 15:
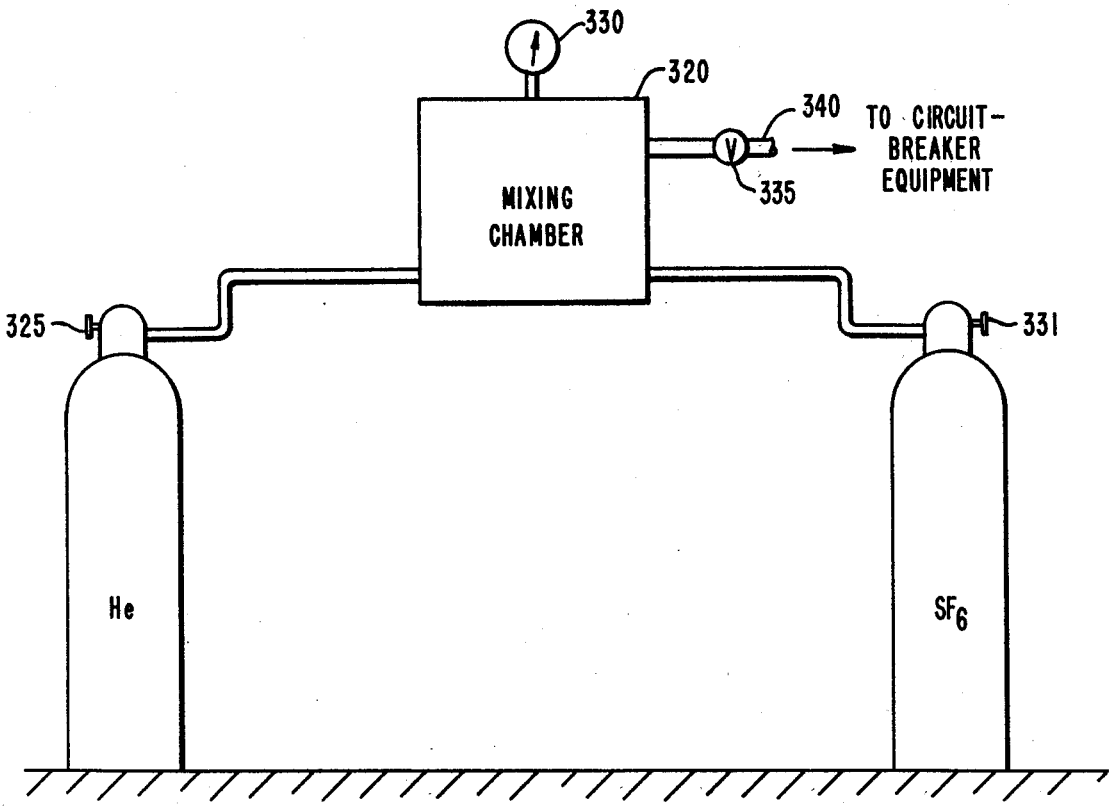

In order to obtain a proper He/$SF_6$ gas mixture containing (say) 5% $SF_6$, by volume, at a total pressure of (say) 300 p.s.i.a. in the mixture chamber 320 in FIG. 15 the following procedure would be adopted: The chamber 320 would first be evacuated, and $SF_6$ gas admitted through the valve 325 until the gas pressure on the pressure gauge 330 was 15 p.s.i.a. Valve 331 would then be closed, and valve 325 opened, and He gas admitted to the mixing chamber 320 until the total pressure was 300 p.s.i.a. Helium would, therefore, have been added to a partial pressure of 285 p.s.i.a., and the admixed gases would be present in the ratio of 285:15, or 19:1 by partial pressure, or by volume. Thus, the mixture of 95% He, 5% $SF_6$ by volume would be present within mixing chamber 320.

The properly admixed gas would, of course, be supplied to circuit-breakers (not shown) through valve 335 and gas line 340.

Although there have been illustrated and described specific structure it is to be observed that the same were merely for the purpose of illustration and that changes and modifications may readily be made therein by those skilled in the art without departing from the spirit and scope of the invention.

I claim as my invention:

1. A circuit-interrupter including as an arc-extinguishing medium an admixture of helium and sulfur-hexafluoride gases, the concentration of the sulfur-hexafluoride ($SF_6$) gas being in the order of one percent up to 10 percent, by volume.

2. A circuit-interrupter including as an arc-extinguishing medium an admixture of helium and sulfur-hexafluoride gases, the concentration of the sulfur-hexafluoride ($SF_6$) gas being in the order of one percent up to 7 percent, by volume.

3. A circuit-interrupter including as an arc-extinguishing medium an admixture of helium and sulfur-hexafluoride gases, the concentration of the sulfur-hexafluoride ($SF_6$) gas being in the order of one percent up to 5 percent, by volume.

4. A circuit-interrupter including as an arc-extinguishing medium an admixture of helium and sulfur-hexafluoride gases, the concentration of the sulfur-hexafluoride ($SF_6$) gas being of the order of 1%, by volume.

5. A circuit-interrupter including means for establishing an arc, means for forcing a blast or admixed He/$SF_6$ gas against the arc to effect the extinction thereof, and the admixed gas comprising an admixture of helium gas and sulfur-hexafluoride gas, with the concentration of the sulfur-hexafluoride gas being in the order of 1 up to 10 percent, by volume.

6. A circuit-interrupter including an enclosure containing an admixture of helium gas and sulfur-hexafluoride gases, with the concentration of sulfur-hexafluoride ($SF_6$) gas being in the order of 1 up to 10 percent, by volume, means for establishing an arc within the enclosure, and the said admixed helium and sulfur-hexafluoride gases being capable of effecting extinction of the said arc.

7. A circuit-interrupter including an enclosure containing an admixture of helium and sulfur-hexafluoride gases with the concentration of the sulfur-hexafluoride ($SF_6$) gas being in the order of 1 up to 10 percent, by volume, and means for forcing the said admixed gases against the arc to effect the extinction thereof.

8. A circuit-interrupter including an enclosure, means providing an orifice member therein, means for establishing an arc adjacent the orifice, means for forcing admixed gas through the orifice into engagement with the established arc to effect the extinction thereof, and said admixed gas being an admixture of helium and sulfur-hexafluoride gases, with the percentage concentration of sulfur-hexafluoride ($SF_6$) gas being in the order of 1 up to 10 percent, by volume.

9. A circuit-interrupter including an enclosure, contact means for establishing an arc within the enclosure, a plurality of spaced arc-splitters, means for causing the arc to be moved against the plurality of arc-splitters, the enclosure containing an admixture of helium and sulfur-hexafluoride gases, with the sulfur-hexafluoride ($SF_6$) gas having a concentration of in the order of 1 up to 10 percent, by volume, and the said admixed gases cooperating with the arc-splitters to extinguish the said arc.

10. A compressed-gas circuit-interrupter including an enclosure, means for establishing an arc within the enclosure, a plurality of insulating arc-splitters disposed laterally of the arc, a gas-reservoir chamber containing an admixed gas comprising helium gas and sulfur-hexafluoride gas, with the percentage concentration of the sulfur-hexafluoride ($SF_6$) gas being in the order of 1 up to 10 percent, by volume, and valve means for releasing a blast of said admixed gas, under pressure, against the established arc to force the latter against the insulating arc-splitters to effect the extinction thereof.

11. A circuit-interrupter of the puffer-type including a relatively-stationary contact structure, a movable operating cylinder carrying a movable contact structure and a hollow insulating orifice structure, means defining a relatively-stationary piston, said operating cylinder sliding over said stationary piston to compress gas therebetween, an enclosure for containing the said parts, an admixed gas present within the enclosure comprising an admixture of helium gas and sulfur-hexafluoride gas, with the percentage concentration of the sulfur-hexafluoride ($SF_6$) gas being in the order to 1 up to 10 percent, by volume, and the arc established between the stationary and movable contacts being subjected to the compressed gaseous admixture of the aforesaid gases by the working motion of the operating cylinder over the said stationary piston to effect a forced flow of the said admixed gases against the established arc, whereby to extinguish the said arc.

12. A circuit-interrupter including a reservoir of admixed gases under pressure, said admixed gas comprising helium gas and sulfur-hexafluoride gas, with the concentration of the sulfur-hexafluoride ($SF_6$) gas being in the order of 1 up to 10 percent, by volume, means for establishing an arc, and means for releasing a portion of said admixed gas under pressure to effect extinction of the arc.

13. A circuit-interrupter including an enclosure, an admixed gas within said enclosure consisting essentially of 1 up to 10 percent of sulfur-hexafluoride gas, by volume, and the remaining concentration of said admixed gas being entirely helium gas.

14. A compressed-gas circuit-interrupter including an enclosure, means for establishing an arc within the enclosure, a reservoir containing an admixed gas consisting essentially of 1 up to 10 percent, of sulfur-hexafluoride gas, by volume, and the remaining portion of said admixed gas consisting essentially of helium gas of at least 90% or more, by volume.

15. A circuit-interrupter of the gas-blast type including a reservoir containing gas comprising an admixture of helium gas and sulfur-hexafluoride gas with the concentration of the sulfur-hexafluoride gas being in the order of 1 up to 10 percent, by volume, said admixed gas being maintained under pressure, orifice means, means for establishing an arc through said orifice means, and blast-valve means for releasing a portion of said admixed gas under pressure through the orifice means to effect extinction of the arc therein.

16. A circuit-interrupter of the gas-type, including as an arc-extinguishing medium, an admixed gas consisting essentially of admixed helium gas and sulfur-hexafluoride gas, with the concentration of sulfur-hexafluoride gas being in the order of 1 up to 10 percent, by volume.

17. A circuit-interrupter of the gas-type, including as an arc-extinguishing medium, an admixed gas consisting essentially of admixed helium gas and sulfur-hexafluoride gas, with the concentration of sulfur-hexafluoride gas being in the order of 1 up to 6 percent by volume.

18. A circuit-interrupter of the gas-type, including as an arc-extinguishing medium, an admixed gas consisting essentially of admixed helium gas and sulfur-hexafluoride gas, with the concentration of sulfur-hexafluoride gas being in the order of 1 up to 4 percent by volume.

19. A circuit-interrupter including as an arc-extinguishing medium, an admixed gas consisting of helium gas and sulfur-hexafluoride gas, with the percentage concentration of the sulfur-hexafluoride gas being in the order of 1 up to 10 percent by volume.

20. A circuit-interrupter including as an arc-extinguishing medium, an admixed gas consisting of admixed helium gas and sulfur-hexafluoride gas, with the percentage concentration of the sulfur-hexafluoride gas being in the order of 1 up to 6 percent by volume.

21. A circuit-interrupter including as an arc-extinguishing medium, an admixed gas consisting of admixed helium gas and sulfur-hexafluoride gas, with the percentage concentration of the sulfur-hexafluoride gas being in the order of 1 up to 4 percent by volume.

22. A circuit-interrupter including as an arc-extinguishing medium, an admixed gas consisting of admixed helium gas and sulfur-hexafluoride gas, with the percentage concentration of the sulfur-hexafluoride gas being substantially 1% by volume.

* * * * *